US005469904A

United States Patent [19]

Kontiainen

[11] Patent Number: 5,469,904

[45] Date of Patent: Nov. 28, 1995

[54] APPARATUS AND PROCEDURE FOR CUTTING SQUARE TIMBER

[76] Inventor: Veijo Kontiainen, Selkiöntie 5, FI-76100 Pieksämäki, Finland

[21] Appl. No.: 211,933

[22] PCT Filed: Oct. 19, 1992

[86] PCT No.: PCT/FI92/00279

§ 371 Date: Apr. 20, 1994

§ 102(e) Date: Apr. 20, 1994

[87] PCT Pub. No.: WO93/08002

PCT Pub. Date: Apr. 29, 1993

[30] Foreign Application Priority Data

Oct. 23, 1991 [FI] Finland ..... 91500

[51] Int. Cl.[6] ..... B27B 1/00; B27C 9/00

[52] U.S. Cl. ..... 144/370; 144/3 R; 144/39; 144/367; 144/357; 144/378

[58] Field of Search ..... 144/2 R, 3 R, 144/39, 41, 356, 357, 246 R, 369, 370, 373, 375, 367, 378

[56] References Cited

U.S. PATENT DOCUMENTS 4,139,035 2/1979 Bystedt et al. .
4,440,203 4/1984 Östberg .
4,548,247 10/1985 Eklund ..... 144/39
4,572,256 2/1986 Rautio .
4,599,929 7/1986 Dutina ..... 144/41
4,881,584 11/1989 Wislocker et al. .
5,148,847 9/1992 Knorr ..... 144/378

FOREIGN PATENT DOCUMENTS 158580 10/1985 European Pat. Off. .
453976 3/1988 Sweden .
464692 6/1991 Sweden .

OTHER PUBLICATIONS

International Search Report PCT/FI 92/00279 dated Dec. 10 1992.

*Primary Examiner*—W. Donald Bray
*Attorney, Agent, or Firm*—Andrus, Sceales, Starke & Sawall

[57] ABSTRACT

Procedure and apparatus for sawing a square timber, the apparatus comprising a feed mechanism (1), a chipper (2) and a sawing apparatus (3) in such manner that .the feed mechanism has been arranged to feed the square timber into the chipper, the chipper has been arranged to remove from the square timber its curved surface portions, and the sawing apparatus has been arranged to cut up the spar arriving from the chipper. As taught by the invention, the feed mechanism (1) is connected with a pivot (4) with vertical axis to the chipper, and the chipper is connected with a second pivot (5) with vertical axis to the sawing apparatus which is carried on the frame of the apparatus, and that the apparatus comprises a feed table (6) for feeding the square timber in controlled manner into the feed mechanism.

11 Claims, 1 Drawing Sheet

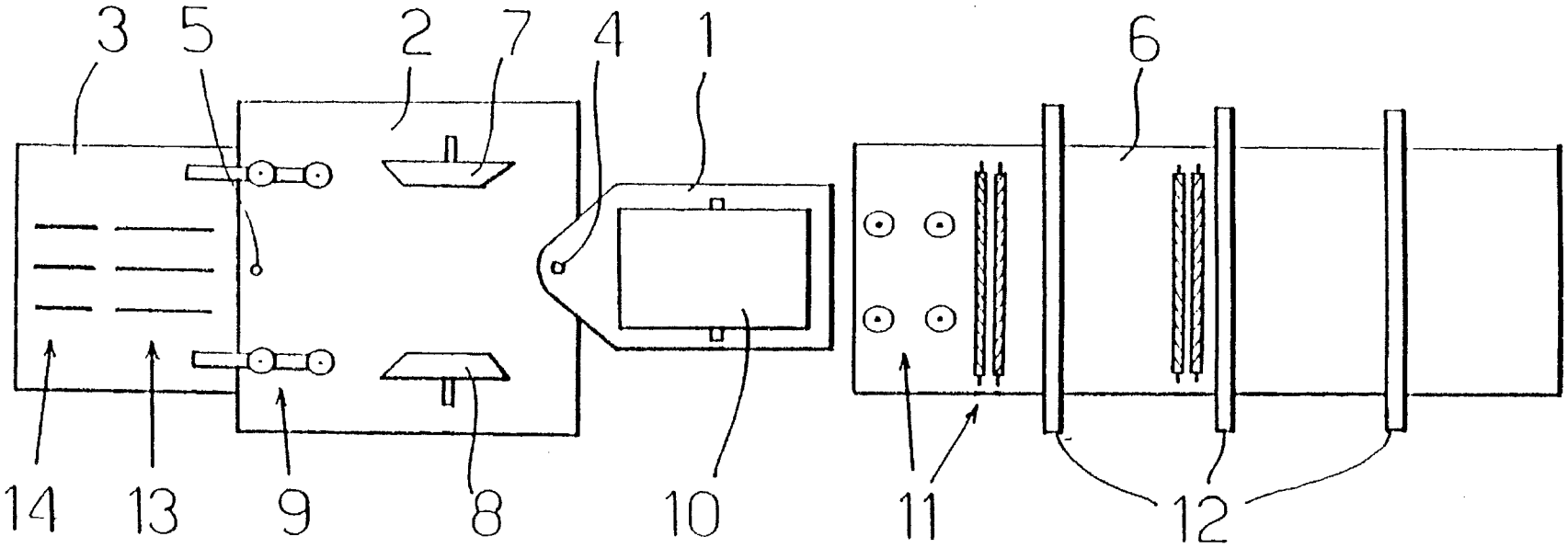
1
2
3
4
5
6
7
8
9
10
11
12
13
14

APPARATUS AND PROCEDURE FOR CUTTING SQUARE TIMBER

The present invention concerns an apparatus for sawing a square timber, a spar or a plank, and a method for dividing a square timber, spar or plank into parts.

A person aiming to utilize timber material optimally will encounter problems, most particularly when curting up crooked logs. In such instances the usual procedure is to first turn the log so that the crook or bend points up or down, and it is dressed to become a square timber having two opposed planar surfaces, this being accomplished by running it through a saw or e.g. through a square timber hewing machine, or chipper. The crooked square timber may then be dressed to become a spar of which all side faces are dressed, by running it e.g. through a second chipper. The result hereby produced is a crooked spar, which is not necessarily uniform in thickness over its entire length, and therefore this timber cannot be sawn over its whole length to yield full-sized sawn timber.

In the interest of simplicity, this application mainly speaks of square timber when referring to (small) square timbers, spars, planks or equivalent timber goods to be processed. Another alternative is to cut the square timber with a saw directly in one work step into boards and deals. Both ways of accomplishing the task are troubled by the same problems. It is hard to rip a crooked square timber or spar into timbers of uniform thickness over its whole length because its curvature frequently varies and rotates and the thickness changes, whereby it is difficult to guide the timber to meet the saw blades in an optimal manner.

The state of art in the field of the present invention is presented in the Finnish Patents 68014, 8778 and 81985, and in U.S. Pat. No. 4,127,044. In all these pieces of apparatus described in the references, too, the problem is that cutting of the square timber, or spar, into boards and deals is not successfully managed, at least not when the curvature of the log varies and changes direction while cutting is in progress. In general, satisfactory results are only achievable with existing apparatus when the log that is being ripped is uniformly curved over its entire length.

The object of the invention is to eliminate the drawbacks just mentioned. It is specifically an object of the invention to provide a novel apparatus and procedure by the aid of which one gains from crooked logs their optimum sawn timber output, independent of curvature variations and changes of direction of the curvature in the log.

Regarding the features characterizing the invention, reference is made to the claims section.

The apparatus of the invention for cutting square timber comprises a feed mechanism, a chipper and a sawing apparatus in such manner that the feed mechanism has been arranged to feed the square timber into the chipper, the chipper is arranged to remove from the square timber its curved superficial portions, and the sawing apparatus is arranged to cut the spar emerging from the chipper into boards, deals and equivalent As taught by the invention, the feed mechanism is connected to the chipper by means of a pivot with a vertical axis, and the chipper is connected to the sawing apparatus by means of another pivot with a vertical axis, said sawing apparatus being carried on the frame of the overall apparatus. The apparatus furthermore comprises a feed table from which the square timber is fed, in controlled manner, into the feed mechanism. The apparatus likewise comprises a control unit, by the aid of which the feed mechanism and the chipper are swivelled about their pivots, both relative to each other and relative to the sawing apparatus, in accordance with the curvature of the square timber that is being processed.

In this way, in the apparatus of the invention, the chipper and the feed mechanism both follow the shape of the square timber and spar which is being cut, i.e., its curvature, and turn it along with themselves so that it will be fed into the saw blades parallelling these blades at all times. This has the effect of precluding any torsion effects on the square timber or on the spar and, likewise, any forces from the spar tending to twist the saw blades, whereby ruptures which occur in the technique of the prior art at the sites of knots in the square timber or spar are successfully eliminated, as are also later detachments of knots.

Advantageously, the sawing apparatus employed in the apparatus is an entity stationary in relation to the frame of the apparatus, other parts of the apparatus being swivelled in relation to the sawing apparatus as implied by the curvature of the log that is being cut. Of course, the possibility is not excluded either that the sawing apparatus could also be swivelled when required. It is equally possible to contemplate swivelling of the parting knives following after the saw blades of the sawing unit, although the fact is that usually, at least when thinner sawn timber is being produced, the sawn timber will readily bend enough as it passes the parting knives to obviate the need of swivelling these knives.

No limitations whatsoever are imposed on the sawing apparatus to be used in the apparatus of the invention: one may use a circular saw, a band saw, or possible other apparatus. Also the number of blades in the sawing apparatus and their spacing may vary and may be freely selectable and adjustable consistent with each object to be cut up and with the products required in each instance.

Advantageously, guides are provided in the apparatus of the invention between the chipper and the sawing apparatus, e.g. suitable rolls with vertical axis, with the aid of which the spar which is going to be cut up is guided into the sawing apparatus, but such guides are so fixed or carried on the sawing apparatus that they can turn along with the chipper slightly as the chipper is swivelled relative to the sawing apparatus, or they are carried on the sawing apparatus by elastic arms, whereby they will yield slightly to the spar presenting curved shape.

Advantageously, the feed mechanism comprises rollers, rolls or equivalent disposed to rest against the planar faces of the square timber and to impact it between themselves, transporting the square timber into the chipper.

In the apparatus of the invention, the parting knives following after the blades may also be pivoted to swivel as one entity out from the direction defined by the blades, whereby they too will swivel and yield in a way consistent with the curvature of the goods that are being cut. In such a case the parting knives are advantageously comprised, in combination, in a separate frame which is pivotally mounted on the blade frame.

Advantageously, various guiding members may be used on the feed table, by the aid of which the square timber is transported in proper position to the feed mechanism. It is equally possible to swivel the feed mechanism relative to the square timber on the feed table so that the square timber will be properly positioned as it moves in between the rollers of the feed mechanism.

Advantageously, in the apparatus of the invention the feed table comprises appropriate measuring elements, measuring frames or equivalent by the aid of which the dimensions of the square timber are measured, such as its length, thickness and crookedness, in which case the results of measurement serve as basis for turning the feed mechanism and the chipper in relation to each other and to the sawing apparatus and the square timber is transported from one treatment step to the other in accordance with commands from the control unit comprised in the apparatus.

In the procedure of the invention for dividing a square timber into parts, the square timber is guided to pass through between chipper blades removing its curved sides and to a dividing apparatus for dividing said square timber into parts. As taught by the invention, the square timber is guided to the dividing apparatus in accordance with its inherent crookedness, turning the entity constituted by the chipper blades and the feed mechanism rolls, relative to the dividing apparatus, and by swivelling the rolls of the feed mechanism relative to the chipper blades, whereby the square timber will be guided to the dividing apparatus, e.g. to a set of saw blades, at all times parallelling the blades, as the other units participating in handling the square timber swivel in accordance with the timber's curvature and turn it so as to keep the part of the square timber at the dividing apparatus parallel with the blades thereof at all times.

Thus, advantageously, in the procedure of the invention the length, thickness and curvature of the square timber are measured prior to taking the timber up on the feed mechanism, either the feed mechanism or the square timber being turned so as to make the square timber enter the gap between the rolls of the feed mechanism in a fully determined position, whereafter in accordance with the progress of the square timber through the apparatus, and in accordance with the curvature of the timber, the various units processing the timber are swivelled relative to each other so that the square timber will be successfully divided on its entire length into boards, deals or equivalent which parallel its curvature.

The apparatus and procedure of the invention afford the advantage, compared with prior art, that they enable optimum yield to be obtained from every log which is processed, regardless of the log's curvature, of changes of this curvature and of changes in direction of the curvature.

BRIEF DESCRIPTION OF THE DRAWING

In the drawing an apparatus according to the invention for sawing square timber is schematically depicted.

The apparatus of the figure comprises a sawing apparatus 3, comprising blades 13 and coordinated parting knives 14, and the number and location of these blades and knives being freely selectable and adjustable as required. On the sawing apparatus is carried, with a pivot 5 having a vertical axis, a chipper 2 presenting opposed chipping blades 7 and 8, of which the mutual distance can be adjusted in accordance with the dimensions of the square timber to be chipped. Further supported on the sawing apparatus 3, in the region of the pivot 5, have been provided guides 9, rolls, which guide the square timber to the blades 13 along lines substantially determined by the chipping blades.

On the chipper 2 is carried, swivellably around a pivot 4 with a vertical axis, a feed mechanism 1, consisting of two rollers, or rolls, 10 pressing against each other and between which the square timber is carried through to the chipper 2.

Furthermore, the apparatus of the invention comprises a feed table 6 carrying measuring elements 12, three measuring frames, and guide members 11 for transporting the square timber in controlled manner to the feed mechanism 1.

The apparatus according to the invention depicted in the drawing is operated as follows. When a log, or square timber, dressed to be planar on two opposed sides, either sawn or chipped, is conveyed onto the feed table 6, the measuring elements 12, representing a technology known in itself in the art, measure and record the dimensions of the square timber, i.e., its length, thickness and curvature. Next, guiding members 11, either helix rolls or rollers with vertical axes, or both, are employed to guide the end of the square timber in between the rolls 10 of the feed mechanism 1. It is equally possible to turn the feed mechanism 1 on its pivot 4, to receive the square timber in a direction perpendicular against the axes of the rollers 10.

Hereafter, the feed mechanism 1 having taken the square timber in between its rolls, the influence of the guide members 11 on the square timber is discontinued e.g. by lowering said guide members down below the level of the feed table 6. Hereby, the square timber being impacted between the rolls of the feed mechanism 1, the square timber can turn freely on the feed table 6, along with the swivelling of the feed mechanism. The feed mechanism 1 is now operated to feed the square timber in between the chipping blades 7 and 8 of the chipper 2, whereby now the curved surfaces unfit to be cut into sawn timber are dressed off; and the spar thus obtained is guided into the blades 13 of the sawing apparatus 3, under guidance by the guides 9.

It is essential in the apparatus of the invention that since the dimensions and configurations of the square timber to be processed have been accurately measured and are known to the control unit, the transporting of the square timber through the entire apparatus takes place under scrupulous control by the control unit in such manner that the various parts of the apparatus are continuously turned and adjusted in accordance with the curvature of the square timber passing therethrough, the feed mechanism 1 and chipper 2 turning together, on the-pivot 5, relative to the sawing apparatus, and the feed mechanism 1 turning on the pivot 4 relative to the chipper, freely and independent of each other, so that also if the curvature changes direction, i.e., the square timber has S shape, the different component parts of the apparatus follow the square timber accurately and move it so that it will arrive at the blades 13 of the sawing apparatus 3 with its direction the same as that of the blades, at all times.

In the foregoing the invention has been described by way of example with the aid of the attached drawing, while various embodiments of the invention are feasible within the scope of the inventive idea delimited by the claims.

I claim:

1. An apparatus for sawing a timber into a plurality of boards, said timber having a longitudinal axis and having a generally square cross-sectional shape in a plane lying generally normal to the longitudinal axis, said timber being curved along said longitudinal axis, said apparatus comprising:

a frame;

a feed table (6) on which the timber to be sawed is placed;

a feed mechanism (1) for receiving the timber from said feed table and feeding said timber in a direction generally parallel to its longitudinal axis;

a chipper (2) coupled to said feed mechanism by a first pivot means (4) by which the feed mechanism and chipper can move relative to each other, said first pivot means having a rotational axis oriented normal to the feeding direction for said timber, said chipper receiving said timber from said feed mechanism and removing curved portions from said timber as the timber passes through said chipper;

sawing means (3) mounted on said frame of said apparatus, said sawing means being said coupled to said chipper by a second pivot means (5) by which said chipper can move relative to said sawing means, said second pivot means having a rotational axis oriented normal to the feeding direction for said timber, said sawing means receiving the timber from said chipper and sawing the timber into boards as said timber passes through said sawing means; and control means for moving said feed mechanism and said chipper relative to each other about said first pivot means and for moving said chipper relative to said sawing means about said second pivot means in accordance with the curvature of said timber as said timber moves through said apparatus.

2. An apparatus according to claim 1 wherein said sawing means is mounted on said frame of said apparatus so as to be stationary with respect to said frame.

3. An apparatus according to claim 1 wherein said chipper comprises a pair of chipping blades (7, 8) spaced in a direction normal to the direction said timber passes through said chipper.

4. An apparatus according to claim 1 further including guide means between said chipper and said sawing means for guiding the timber into said sawing means.

5. An apparatus according to claim 1 wherein said feed mechanism comprises a pair of spaced rolls between which said timber is fed.

6. An apparatus according to claim 1 wherein said feed table comprises guide members (11) for positioning the timber to be sawed on said feed table.

7. An apparatus according to claim 6 wherein said feed table (6) further includes measuring means (12) for measuring dimensional characteristics of said timber to be sawed said measuring means being coupled to said control means.

8. An apparatus according to claim 1 wherein said sawing means (3) comprises a plurality of blades (11) adjustably positioned with respect to each other in accordance with the dimensional characteristics of the timber being sawed and the dimensions of the boards produced from said timber, said blades having a parting knives associated therewith.

9. An apparatus according to claim 8 wherein said parting knives are pivotable relative to said blades.

10. A method for dividing a timber into a plurality of boards, said timber having a longitudinal axis and having a generally square cross-sectional shape in a plane lying generally normal to the longitudinal axis, said timber being curved along said longitudinal axis, said method comprising the steps of:

feeding the timber, in a direction parallel its longitudinal axis, from a feed mechanism to a chipper;

passing the timber through the chipper and removing curved portions from the timber as it passes through the chipper;

passing the timber through a dividing means and dividing the timber into boards as it passes through the dividing means;

moving the feed mechanism and the chipper relative to each other about a first rotational axis oriented normal to the feeding direction for the timber as the timber moves through the feeding mechanism and chipper; and moving the chipper relative to the dividing means about a second rotational axis oriented normal to the feeding direction for the timber as the timber moves through the chipper and dividing means.

11. A method according to claim 10 further including the initial step of ascertaining the dimensional characteristics of the timber and wherein the step of relatively moving the feed mechanism and chipper is further defined as carrying out the movement in accordance with the ascertained characteristics of the timber.

* * * * *